US006880584B1

(12) United States Patent
Myogi

(10) Patent No.: US 6,880,584 B1
(45) Date of Patent: Apr. 19, 2005

(54) WEFT END COLLECTOR

(75) Inventor: Keiichi Myogi, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 62 days.

(21) Appl. No.: 10/432,211

(22) PCT Filed: Oct. 2, 2002

(86) PCT No.: PCT/JP02/10296

§ 371 (c)(1),
(2), (4) Date: May 21, 2003

(87) PCT Pub. No.: WO03/031704

PCT Pub. Date: Apr. 17, 2003

(30) Foreign Application Priority Data

Oct. 3, 2001 (JP) ..... 2001-307369

(51) Int. Cl.[7] ..... D03D 47/30; D03D 47/32

(52) U.S. Cl. ..... 139/435.1; 139/435.2; 139/435.3; 139/435.4; 139/435.5; 139/435.6; 139/194

(58) Field of Search ..... 139/435.1–435.6, 139/194

(56) References Cited

U.S. PATENT DOCUMENTS 4,351,369 A * 9/1982 Arakawa ..... 139/435.1
4,498,504 A * 2/1985 Allen et al. ..... 139/302
4,664,157 A * 5/1987 Shin ..... 139/116.2
4,815,501 A * 3/1989 Takehana ..... 139/429
4,976,292 A * 12/1990 Matsumoto ..... 139/194
5,295,516 A * 3/1994 Tanaka et al. ..... 139/452
5,564,473 A * 10/1996 Schaich et al. ..... 139/28

FOREIGN PATENT DOCUMENTS

JP 52-105296 A 9/1977
JP 02104753 A * 4/1990 ..... D03J/1/00
JP 02289148 A * 11/1990 ..... D03D/47/34
JP 03040831 A * 2/1991 ..... D03D/23/00
JP 7-6103 1/1995
JP 10-195739 A 7/1998

* cited by examiner

*Primary Examiner*—John J. Calvert
*Assistant Examiner*—Robert H Muromoto, Jr.
(74) *Attorney, Agent, or Firm*—Webb Ziesenheim Logsdon Orkin & Hanson, P.C.

(57) ABSTRACT

A weft end recovery apparatus comprises weft end carrier for carrying by water flow weft ends formed as a result of weft insertion, a plurality of storing and dewatering sections to receive the weft ends carried from the weft end carrier together with the water, and switching mechanism for selectively switching the storing and dewatering sections to store the weft ends and the water from the weft end carrier.

5 Claims, 4 Drawing Sheets

WEFT END COLLECTOR

BACKGROUND OF THE INVENTION

1. Field of the Invention

The present invention relates to a weft end recovery apparatus in a fluid jet loom for carrying and recovering by a water flow weft ends caused by weft insertion.

2. Description of Prior Art

In a fluid jet loom such as a water jet loom, the weft is inserted into a shedding of the warp, followed by reed beating, and then cut away from a fabric. For this reason, a fluid jet loom is generally provided with a device for recovering weft ends cut away from a fabric.

As one of such weft end recovery apparatuss, there is disclosed a apparatus which carries weft ends cut away from a fabric by a carrier device using a water flow and recovers the weft ends into a recovery vessel by flowing them down from above the vessel together with water (Japanese Patent Appln. Public Disclosure (KOKAI) No. 10-195739).

In this conventional weft end recovery apparatus, the recovery vessel separates the weft ends and the water with a filter disposed in the vessel. The separated weft ends are recovered by an operator from the recovery vessel at a suitable time, and the water is recovered into a water tank to be reused for carrying and so forth of the weft ends.

On the other hand, in a shuttleless loom, stopping the loom must be avoided for the purpose of recovering weft ends from a recovery vessel in view of preventing generation of stopped stages, improving a rate of operation, etc.

Consequently, according to the conventional weft end recovery apparatus, an operator cannot avoid contacting the water and the weft ends dropping from above when taking out and recovering the weft ends from a storing and dewatering section, as a result of which they bound and scatter around the recovery apparatus.

When the water and the weft ends thus scatter around the recovery apparatus, the operator should wipe away the scattered water and recover the scattered weft ends every time the weft ends are recovered. Further, the scattered weft ends get dirty with oil, dust, etc., around the recovery apparatus, and such dirt prevents recycling of the recovered weft ends.

Though the conventional weft end recovery apparatus has a filter in the recovery vessel, the weft ends to be recovered contain a large quentity of water which drops from the carrier device, so that the weft ends to be recovered are heavy and bulky, resulting in inferior operability in recovery. Furthermore, the weft ends must be dewatered after the recovery and then stored.

SUMMARY OF THE INVENTION

An object of the present invention lies in facilitating the recovery of weft ends from a recovery apparatus.

The weft end recovery apparatus according to the present invention comprises: weft end carrier for carrying by a water flow weft ends formed as a result of weft insertion; a plurality of storing and dewatering sections for receiving together with water the weft ends discharged from an outlet of the weft end carrier and storing the same; and switching mechanism for selectively switching the storing and dewatering sections to receive the water from the weft end carrier.

In the weft end recovery apparatus, there always exist the storing and dewatering section which receives the water and the weft ends from the weft end carrier (i.e., in a watery state) and the storing and dewatering section which does not receive the same (i.e., in a non-watery state). For this reason, the weft ends can be recovered from the non-watery storing and dewatering section. Consequently, even if the loom is in operation, the weft ends can be recovered without scattering the water and the weft ends from the weft end carrier around the recovery apparatus.

Dewatering can be done by a natural flow or a compulsory discharge of the water from the storing and dewatering sections. When the watery storing and dewatering section is switched to the non-watery state, dewatering from the storing and dewatering section goes on. Also, the work to recover the weft ends may be carried out from the time the non-watery storing and dewatering section was switched to the non-watery state by the time before it is switched back to the watery state. Therefore, a time elapses after switching to the non-watery state, which enables to recover the dewatered and not bulky weft ends, thus facilitating the recovering work and omitting or simplifying a process of newly dewatering the recovered weft ends.

The weft end recovery apparatus can further comprise: a sensor for detecting that the weft ends stored within the watery storing and dewatering section has reached a reference amount; informing device for notifying so as to recover the weft ends within the non-watery storing and dewatering section; and a controller for outputting a recovery notificating signal to the informing device, based on a detection signal by the sensor. Thus, it is possible to inform the operator of arrival of the time for recovering the weft ends from the storing and dewatering section, by lighting a notifying lamp of the informing device with the recovery notification signal from the controller, or by providing a buzzer as informing device and sounding the buzzer.

The switching mechanism can include a common case where all the storing and dewatering sections are disposed, and the case can be moved so as to switch the storing and dewatering sections to receive the water. This enables to recover the weft ends by moving the case, then by moving the storing and dewatering section which should recover the weft ends to a position where this section gets in the non-watery state but where the weft end carrier and other devices do not prevent the recovering work, thereby facilitating the recovering work. Also, since all the plural storing and dewatering sections are integrally moved by the common case, all the plural storing and dewatering sections are simultaneously moved at the time of switching, thereby making the switching smoothly.

In the weft end recovery apparatus, the case can be made to rotate so as to switch the storing and dewatering sections to receive the water. Thus, by rotating the case, the storing and dewatering section which becomes heavy by storing a lot of weft ends can be easily moved, thereby making easier the switching of the water-receiving storing and dewatering sections to receive the water flow.

The switching mechanism can include a moving mechanism for moving the outlet so as to switch the water-receiving storing and dewatering section. Thus, due to the movement of the outlet of the weft end carrier, the discharging direction and the position of the outlet is changed to switch the storing and dewatering section, there is no need to move the storing and dewatering section which has become heavy with the weft ends stored, thereby facilitating the switching work. It is also possible to provide an outlet in every storing and dewatering section and to selectively switch each outlet from an open outlet to a closed outlet and vice versa by switching mechanism such as a valve.

PREFERRED EMBODIMENT OF THE INVENTION

Figure 1:
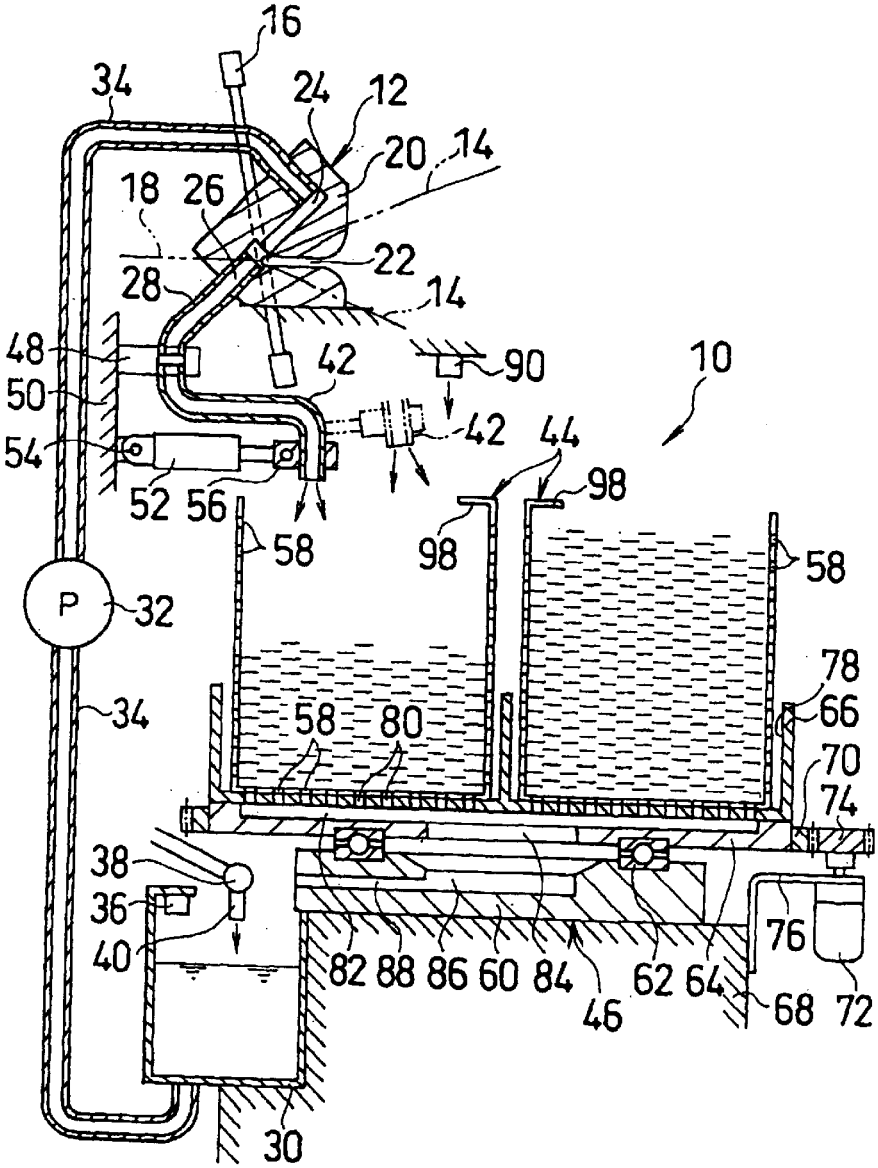
FIG. 1 is a view showing an embodiment of the weft end recovery apparatus according to the present invention.
Figure 2:
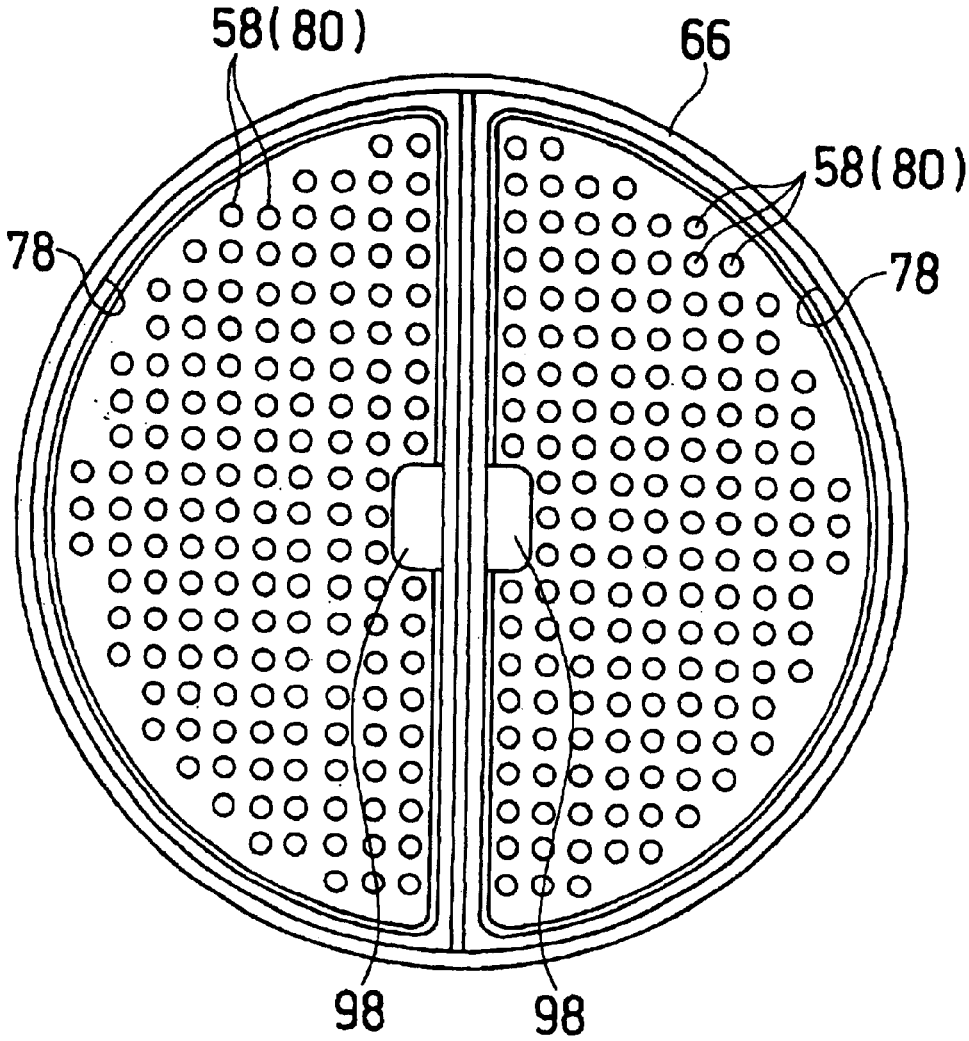
FIG. 2 is a plan view of a storing and dewatering tank and a switching mechanism in the weft end recovery apparatus shown in FIG. 1.
Figure 3:
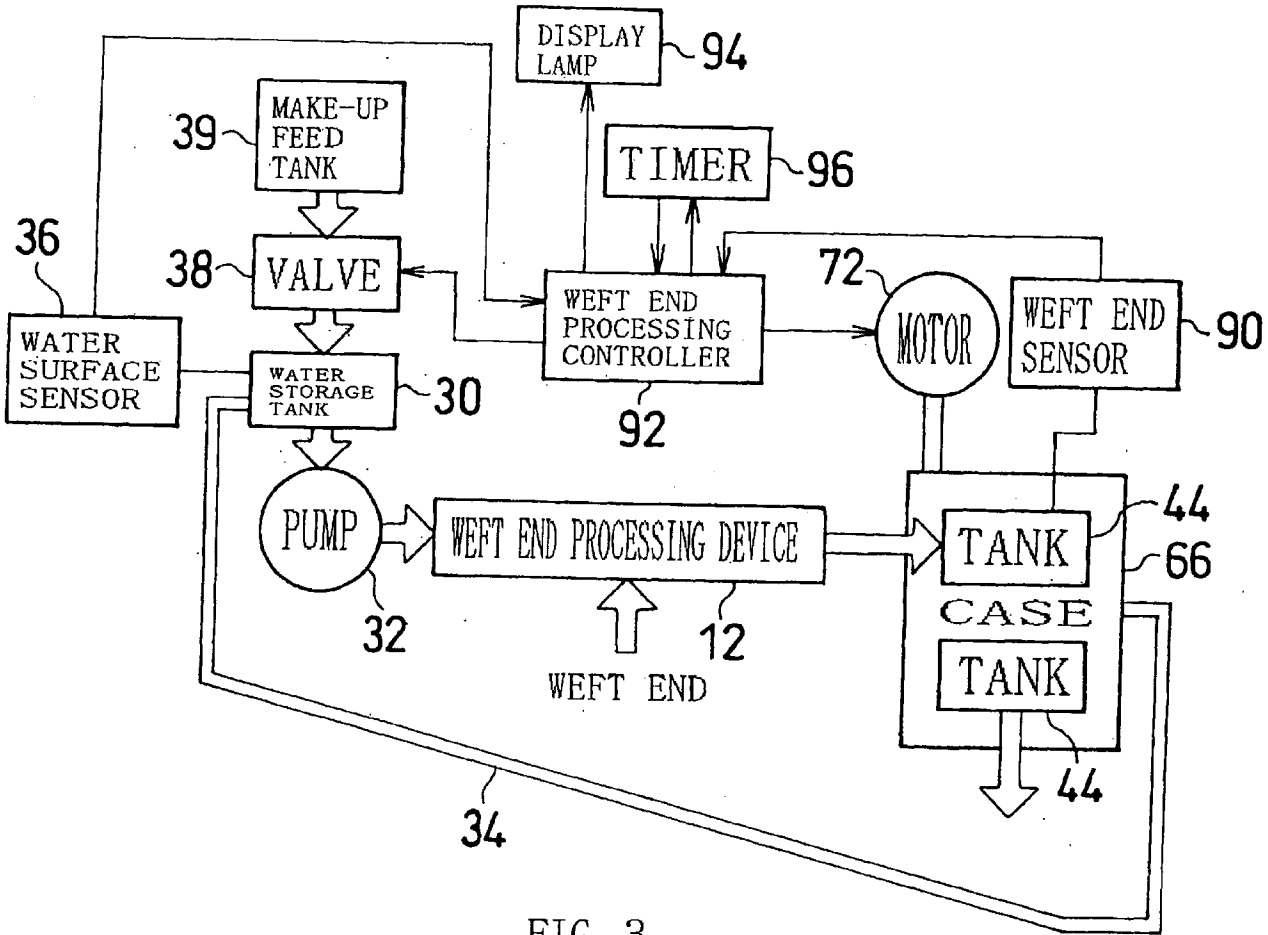
FIG. 3 is a block diagram showing an embodiment of an electric circuit in the weft end recovery apparatus shown in FIG. 1 together with the water flow.

Referring to FIGS. 1–3, the weft end recovery apparatus 10 is applied to a water jet loom together with a weft end processing device 12.

The water jet loom inserts the weft (not shown) from a weft insert nozzle (not shown) into a shedding of the warp 14 by pressure water, restrains and holds the front end of the inserted weft by the weft end processing device 12, and beats the weft in that state against a cloth fell by a reed to form a fabric 18. The beaten weft front ends are cut away from the fabric 18, thereby forming weft ends.

The weft end processing device 12 includes a block-shaped weft catching bracket 20 for catching the front ends of the weft. The catching bracket 20 makes the weft front ends pass by receiving the front ends of the weft to be beaten into a slit 22 and discharging the pressure water from a discharge channel 24 via the back of the slit 22 into an exhaust channel 26. Thus, the weft front ends are brought into contact with the pressure water at the back of the slit 22, hauled into the exhaust channel 26 to be restrained and held.

The slit 22 has a horizontal U-shape so as to receive the weft to be beaten from the upstream side in the moving direction of the warp 14. The weft is received into the slit 22 such that the front end penetrates the weft catching bracket 20 in the thickness direction. The exhaust channel 26 is formed by a pipe 28 whose upper end portion is inserted into the weft catching bracket 20 from below to the back of the slit 22.

The pressure water is supplied from a water storage tank 30 via a pipe 34, 34 to the discharge channel 24 by a pump 32. The pressure water discharged into the exhaust channel 26 is recovered by the weft end recovery apparatus 10 together with the cut-away weft ends and returned from the weft end recovery apparatus 10 to the water storage tank 30 to be recycled as the pressure water again.

The water surface inside the water storage tank 30 is sensed by a water surface sensor 36, and when it is below a predetermined level, a solenoid valve 38 is opened to supplement the water in a make-up feed tank 39 (not shown) from a water inlet 40 so that the level can be maintained within a predetermined allowable range.

The weft end recovery apparatus 10 comprises: a flexible hose 42 connected to the lower end of the pipe 28; two storing and dewatering tanks 44 for receiving the water and the weft ends discharged from an outlet formed at the lower end of the hose 42; and a switching mechanism 46 for selectively switching the storing and dewatering tanks 44 to receive the exhaust water from the hose 42.

The hose 42 forms together with the pipe 28 a path or a carrying channel for carrying the weft ends and constitutes weft end carrier together with the pump 32, the pipe 34 and the discharge channel 24 which also constitute the weft end processing device 12, and forms a carrier water flow for the weft ends. The hose 42 is, at its upper end, assembled into a frame 50 of the loom together with the lower end portion of the pipe 28 by an assembling tool 48.

Instead of providing the hose 42 and another pipe 28, it is possible to insert the upper end portion of the hose 42 into the weft catching bracket 20 to utilize the upper stream side of the inner space as the exhaust channel 26.

The hose 42 is attached at its lower end portion to a fluid pressure cylinder 52 so as to make the weft ends as well as the water flow into the storing and dewatering tanks from above. The cylinder 52 is pivotally assembled into the frame 50 by a pivot pin 54 extending horizontally.

The fluid pressure cylinder 52 has the lower end portion of the hose 42 attached to a piston rod by the assembling tool 56. This makes the outlet formed at the lower end of the hose 42 oscillate by extension and contraction of the fluid pressure cylinder 52 about the neighborhood of the assembling tool 56 of the hose 42 and displace relative to the watery storing and dewatering tank 44. By this, the position for the weft ends to reach the storing and dewatering tank 44 is varied, and the weft ends are evenly deposited, whereby the storing and dewatering tank 44 can store a sufficient amount of the weft ends.

In the illustrated example, there are provided upwardly opened two storing and dewatering tanks 44. Each storing and dewatering tank 44 includes a semicircular bottom wall and vertical peripheral walls perpendicular to the bottom wall. Each of the peripheral wall and the bottom wall has a plurality of holes 58 which permit the water to pass but prevent the weft ends from passing. Each storing and dewatering tank 44, therefore, serves as a storing and dewatering section having a function of a filter which receives the weft ends from the hose 42 together with the water.

The switching mechanism 46 has a disk-shaped turntable 64 mounted on a disk-shaped support base 60 through one or more bearings 62 so as to rotate about a vertical line, a case 66 disposed on the turntable 64, and both the storing and dewatering tanks 44 disposed on the case 66. The support base 60 is installed on a floor 68.

A ring-shaped gear 70 is assembled into the outer periphery of the turntable 64. The gear 70 is a gear with external cogs and engaged with a gear 74 which is rotated by a motor 72. The motor 72 is assembled into the floor 68 by a bracket 76.

The case 66 has two spaces 78 for storing the storing and dewatering tanks individually as well as a plurality of holes 80 on the bottom wall for passing the water flowing out of the storing and dewatering tanks 44. Each space 78 has a semicircular bottom portion slightly larger than the bottom wall of the storing and dewatering tank 44 for facilitating mounting and removing of the storing and dewatering tank 44 as well as facilitating for the water to flow out of the storing and dewatering tank 44, and is opened upward.

The water having passed the holes 80 of the case 66 is collected by a dent 82 formed in the turntable 66 and opened upward and flows into the water storing tank 30 from a hole 84 communicating to the bottom of the dent 82 through a hole 86 of the support base 60 and a flow path 88.

When weaving, the pressure water is discharged at all times from the discharge channel 24 to the exhaust channel 26 by the pump 32. By this, the weft ends are carried together with the discharged water inside the pipe 26 and the hose 42, flow from the outlet at the lower end of the hose 42 together with the water into the watery storing and dewatering tank 44.

With the volume of the weft when the weft ends to be stored inside the watery storing and dewatering section 44 reaches a predetermined height position given as a reference amount, an ultrasonic weft end sensor 90 detects arrival of the weft ends at the reference amount as reaching the predetermined height position. As a sensor for detecting the predetermined height position, it is possible to use an photoelectric sensor including a projector and a receiver of light or a limit switch which actuates by directly or indirectly contacting deposited weft ends. Also, the weft ends' arrival at a predetermined amount may be detected by a volume controlled sensor such as a strain gauge, with the weight of the weft when the weft ends to be stored within the storing and dewatering section has reached the predetermined amount given as a reference amount.

An output signal of the weft end sensor 90 supplied to a weft end processing controller 92 in FIG. 3 is used as a signal of reaching the reference amount in the weft end processing controller 92, when a predetermined amount of the weft ends are stored in the watery storing and dewatering tank 44.

The weft end processing controller 92 determines, based on a detection signal by the weft end sensor 90, whether or not the amount of the stored weft ends has reached the reference value, and when the reference value is reached, drives the motor 72 to rotate the turntable 64 halfway. Thus, the case 66 with the two storing and dewatering tanks 44 is rotated, the storing and dewatering tank 44 filled with the predetermined amount of the weft ends is moved from the water-receiving position to the recovering position, and the empty storing and dewatering tank 44 from which the weft ends have already been recovered is moved from the recovering position to the water-receiving position.

When switching the storing and dewatering tanks 44, both the storing and dewatering tanks 44 are moved integrally by the common case 66, so that the storing and dewatering tanks 44 are simultaneously moved when switching, thus enabling smooth switching operation.

The weft ends inside the storing and dewatering tanks 44 moved to the recovering position are gradually dewatered and lightened. Besides dewatering due to natural flowing as shown in the embodiment, the centrifugal force may be used to forcibly dewater by rotating the storing and dewatering tanks 44 with the motor or the like.

Thereafter, the weft end processing controller 92 outputs a recovery informing signal after an elapse of the time set in a timer 96 from the detection of the weft ends' reaching the reference amount and lights or blinks a display lamp 94 as the informing device. The informing device may be provided in the loom, or a monitor screen for monitoring the operating state of a plurality of looms may be used as the informing device. Instead of lighting the display lamp, a buzzer as the informing device may be sounded. An operator can come to know that a predetermined time has elapsed for the weft ends to be sufficiently dewatered, and that it is time for him to recover the weft ends from the storing and dewatering tanks 44.

In this embodiment, a device for automatically switching the storing and dewatering tanks 44 by the motor 72 is provided, but it is not necessarily provided. If not provided, switching of the storing and dewatering tanks 44 is made by the operator by manually rotating the case 66 halfway.

While the weft ends from the storing and dewatering tank 44 can be recovered at a suitable time between switching the storing and dewatering tank 44 to receive water and the next switching, it is recommended to recover when the weft end sensor 90 detects the weft ends' arrival at the reference amount and the display lamp 94 is lighted; then, the weft ends are sufficiently dewatered. Immediately after that, the switching of the storing and dewatering tanks 44 is done together. Therefore, the display lamp 94 acts as the informing device to inform the recovery timing as well as the switching timing.

In both cases of automatic switching and manual switching, it is recommendable to recover the weft ends after as much time as possible has elapsed from switching to the non-watery state. During this time, dewatering of the weft ends inside the non-watery storing and dewatering tank 44 advances. As a result, a process for newly dewatering the recovered weft ends can be omitted or simplified.

The work for recovering the weft ends can be done by lifting the non-watery storing and dewatering tank 44 from the case 66 by using a handle 98 and moving the weft ends to another vessel or to the other position. As a result, the weft ends are dewatered to be lightened and not to bulk, which facilitates the work for recovering the weft ends.

When recovering the weft ends, the storing and dewatering tank 44 filled with the weft ends has been moved to a recovering position not hindered by the hose and other machinery, members, etc., so that the work for recovering the weft ends is made easier. The recovered weft ends are served for recycling.

The rotation axis of the switching mechanism 46, which is made perpendicular in the above embodiment, may be inclined. When the rotation axis of the switching mechanism 46 is inclined so as to have a small angle to the perpendicular line, the operator is less interfered by other devices such as the hose 42, the cylinder 52 and the like, at the time of recovery of the weft ends. It is also possible to make the turntable 64 and the case 66 rotate together with the watery storing and dewatering tank 44 by the dead load with an increase in the amount of the stored weft ends and lower watery storing and dewatering tank 44, and then, even if there is no automatic switching device by a motor and the like, the automatic switching of the watery storing and dewatering tank 44 is enabled.

Figure 4:
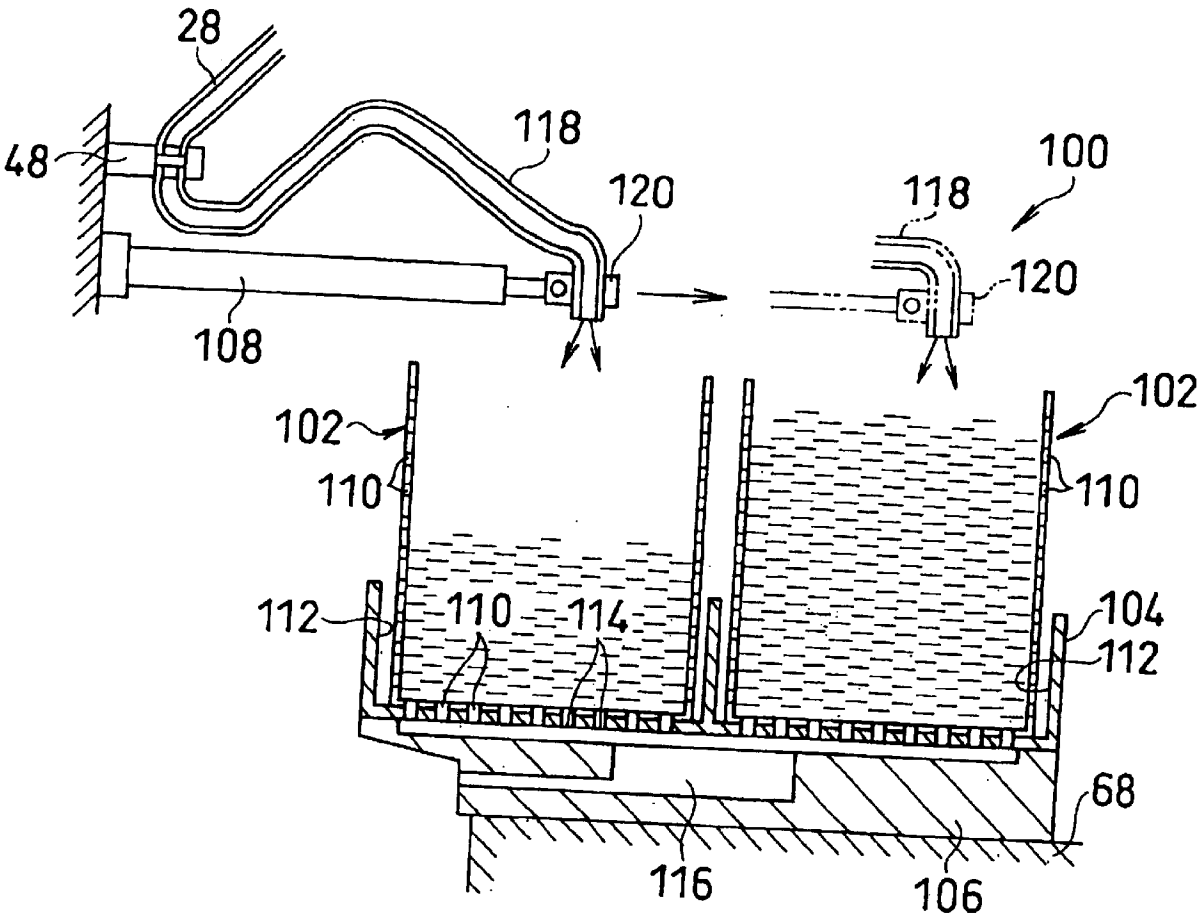
FIG. 4 is a view showing another embodiment of the weft end recovery apparatus according to the present invention.

Referring to FIG. 4, a weft end recovery apparatus 100 has two storing and dewatering tanks 102 mounted on a case 104, the case 104 disposed on a support base 106, and switches the storing and dewatering tanks 102 by a fluid pressure cylinder 108.

Each storing and dewatering tank 102 has a plurality of holes 110, which permit the water to flow but prevent the weft ends from flowing, on the peripheral walls and the bottom wall respectively. Each storing and dewatering tank 102 includes a rectangular bottom wall and four peripheral walls vertical to the bottom wall.

The case 104 has a space 112 for housing the storing and dewatering tanks 102 as well as a plurality of holes 114 for flowing the collected water into the support base 106. The support base 106 has a channel 116 for collecting and flowing the water from the case 104 into a water storage tank not shown.

The fluid pressure cylinder 108 is supported on the frame 50 so as to extend and contract in the direction of arrangement of the storing and dewatering tanks 102.

In the weft end recovery apparatus 100, a flexible hose 118 longer than the hose 42 is used. The hose 118 is connected to the pipe 28 by the assembling tool 48 like the hose 42 and assembled at the lower end portion into a piston rod of the fluid pressure cylinder 108 by an assembling tool 120.

When the fluid pressure cylinder 108 is contracted as shown by a solid line, the left-side storing and dewatering tank 102 in the drawing receives weft ends from the outlet formed at the lower end of the hose 118 together with the water. While in the watery state, the fluid pressure cylinder 108 is extended or contracted within a range for the water from the hose 118 not to reach the next storing and dewatering tank 102, whereby the weft ends are stored evenly in the storing and dewatering tank 102.

When the watery storing and dewatering tank 102 stores a predetermined amount of the weft ends, the fluid pressure cylinder 108 is extended as shown by a broken line. This switches the storing and dewatering tank 102 for receiving the weft ends. The recovery of the weft ends inside the storing and dewatering tank 102 can be performed by pulling out the storing and dewatering tank 102 to the near side.

It is also possible to fork the downstream side of the hose, to provide a solenoid valve to each branch, and to form an outlet at the downstream end 80 as to come above the corresponding storing and dewatering tank. By making the solenoid valve switching mechanism and switching the outlets from one to the other, that is, from an open outlet to a closed outlet, the actually discharging outlet (open outlet) can be moved without depending on the fluid pressure cylinder 108.

Also in the weft recovery apparatus 100, the recovery of the weft ends may be done between after switching the storing and dewatering tanks 102 and the next switching, and it is preferable to recover immediately before switching as the weft ends are in the most dewatered state. Therefore, it is desirable to detect the amount of storage of the weft ends and inform the operator of the timing for recovering the weft ends.

The present invention is not limited to the above embodiments but can be variously modified without departing from the spirit of the invention.

What is claimed is:

1. A weft end recovery apparatus comprising:

weft end carrier for carrying by water flow weft ends formed as a result of weft insertion;

a plurality of storing and dewatering sections for receiving the weft ends discharged from an outlet of said weft end carrier together with water and storing the same; and switching mechanism for selectively switching said storing and dewatering sections to receive the water from said weft end carrier.

2. A weft end recovery apparatus of a fluid jet loom according to claim 1, further comprising:

a sensor for detecting that the weft ends stored in said storing and dewatering section which is in a watery state has reached a reference amount;

informing device for informing the recovery of the weft ends from said storing and dewatering section which is in a non-watery state; and a controller for outputting a recovery notification signal to said informing device on the basis of a detection signal by said sensor.

3. A weft end recovery apparatus of a fluid jet loom according to claim 1, wherein said switching mechanism has a common case for disposing all of said storing and dewatering sections, said case being movable so as to switch said storing and dewatering sections to receive the water.

4. A weft end recovery apparatus of a fluid jet loom according to claim 3, wherein said case is rotatable so as to switch said storing and dewatering section to receive the water.

5. A weft end recovery apparatus of a fluid jet loom according to claim 1, wherein said switching mechanism has a moving mechanism for moving said outlet so as to switch said storing and dewatering sections to receive the water.

* * * * *